US006858105B2

(12) United States Patent
Hartman et al.

(10) Patent No.: US 6,858,105 B2
(45) Date of Patent: Feb. 22, 2005

(54) SPLICING SYSTEM AFFORDING A CONTINUOUS WEB MATERIAL SUPPLY FOR AN APPLICATOR

(75) Inventors: James N. Hartman, Parma, ID (US); Peter M. Downie, Vancouver, WA (US)

(73) Assignee: Adalis Corporation, Vancouver, WA (US)

( * ) Notice: Subject to any disclaimer, the term of this patent is extended or adjusted under 35 U.S.C. 154(b) by 176 days.

(21) Appl. No.: 10/001,080

(22) Filed: Oct. 30, 2001

(65) Prior Publication Data

US 2002/0059982 A1 May 23, 2002

Related U.S. Application Data

(63) Continuation-in-part of application No. 09/703,968, filed on Nov. 1, 2000, now abandoned.

(51) Int. Cl.[7] ..... B65H 21/00

(52) U.S. Cl. ..... 156/159; 156/157; 156/304.3; 242/555; 242/555.1; 242/556; 242/556.1

(58) Field of Search ..... 156/157, 159, 156/251, 267, 269, 270, 304.1, 324, 353, 502, 504, 505, 507, 511, 515, 516, 530, 543, 544, 555; 83/553; 269/218; 100/264, 271; 242/555, 555.1, 555.2, 555.3, 555.4, 555.6, 555.7, 556, 556.1

(56) References Cited

U.S. PATENT DOCUMENTS

| | | | | |
|---|---|---|---|---|
| 3,618,483 A | | 11/1971 | Helm | |
| 3,660,208 A | | 5/1972 | Hubbard | |
| 3,738,587 A | * | 6/1973 | Cristiani | 242/554.2 |
| 3,886,033 A | | 5/1975 | MacDonald et al. | |
| 3,894,905 A | | 7/1975 | Ehlscheid | |
| 3,957,570 A | | 5/1976 | Helm | |
| 4,120,034 A | | 10/1978 | Fisk et al. | |
| 4,181,558 A | | 1/1980 | Neubronne | |
| 4,332,635 A | | 6/1982 | Holbrook et al. | |
| 4,364,787 A | | 12/1982 | Radzins | |
| 4,405,066 A | | 9/1983 | Roccaforte | |
| 4,455,190 A | * | 6/1984 | Bianchetto et al. | 156/504 |
| 4,506,816 A | | 3/1985 | Roccaforte | |
| 4,580,709 A | | 4/1986 | Roccaforte | |
| 4,722,489 A | | 2/1988 | Wommer | |
| 4,795,510 A | | 1/1989 | Wittrock et al. | 156/64 |
| 4,917,327 A | | 4/1990 | Asbury, Jr. et al. | 242/156 |
| 4,925,521 A | | 5/1990 | Asbury et al. | |
| 5,021,111 A | | 6/1991 | Swenson | |
| 5,029,768 A | | 7/1991 | Asbury et al. | |
| 5,078,311 A | | 1/1992 | Taguchi et al. | |
| 5,224,405 A | | 7/1993 | Pohjola | |
| 5,415,716 A | | 5/1995 | Kendall | |
| 5,429,576 A | | 7/1995 | Doderer-Winkler r | |

(List continued on next page.)

FOREIGN PATENT DOCUMENTS

| | | |
|---|---|---|
| DE | 4209262 | 1/1992 |
| EP | 0 776 848 A2 | 11/1995 |
| EP | 0 691 267 | 1/1996 |
| EP | 1 132 325 | 9/2001 |
| GB | 2 143 802 | 2/1985 |
| GB | 2 315 041 | 1/1998 |
| JP | 8-309890 | 11/1996 |
| WO | WO 96/35574 | 11/1996 |
| WO | WO 00/15729 | 3/2000 |
| WO | WO 02/39219 | 5/2002 |

*Primary Examiner*—Sue A. Purvis
*Assistant Examiner*—Cheryl N. Hawkins
(74) *Attorney, Agent, or Firm*—Klarquist Sparkman, LLP

(57) ABSTRACT

An apparatus and method for providing continuous web material to an applicator machine, comprising a placement arm for supporting a length of splicing tape and the end of a substitute roll for attachment to a supply web, and a knife holder mounted for movement from a standby position to a position engaged by the substitute web to trigger movement of the cutting knife of the knife holder for cutting the supply web.

21 Claims, 7 Drawing Sheets

U.S. PATENT DOCUMENTS 5,501,763 A 3/1996 Ueda et al.
5,573,626 A 11/1996 Rossini et al. ..... 156/361
5,624,526 A 4/1997 Perecman et al.
5,692,699 A 12/1997 Weirauch et al. ..... 242/556.1
5,775,629 A 7/1998 Cyr
5,782,736 A 7/1998 Brizzi et al.
5,839,634 A 11/1998 Pollard et al.
5,913,991 A 6/1999 Kubota et al. ..... 156/64
5,947,360 A 9/1999 Frank
6,007,660 A 12/1999 Forkert ..... 156/256
6,013,148 A 1/2000 Bluemle
6,172,698 B1 1/2001 Iwata et al.
6,173,876 B1 1/2001 Sano et al.
6,244,321 B1 6/2001 Sakamoto
6,475,325 B1 11/2002 Parrish et al.
6,488,228 B2 * 12/2002 Davies et al. ..... 242/556.1
2002/0038686 A1 4/2002 Parrish et al.
2002/0050324 A1 5/2002 Middelstadt et al.
2002/0079042 A1 6/2002 Hartman et al.
2002/0079045 A1 6/2002 Parrish et al.

* cited by examiner

SPLICING SYSTEM AFFORDING A CONTINUOUS WEB MATERIAL SUPPLY FOR AN APPLICATOR

CROSS REFERENCE TO RELATED APPLICATION

This application is a continuation-in-part of U.S. patent application Ser. No. 09/703,968, filed Nov. 1, 2000, which is now abandoned.

BACKGROUND

This invention relates to a system for providing a continuous supply of web material to an applicator. This means a splicing system to add the leading end of a fresh roll of web material to the trailing end of an exhausted supply roll. The splicing system has to make a rapid and secure splice so the leading end of the new roll will be threaded into the applicator along a path created for the advance of the web material to the applicator without stopping the supply of web material to the machine. In one aspect the present invention provides an improved splicing system for hot melt adhesive tapes. The splicing system is adapted to make positive contact between the web material ends without special end structures, and the system uses sufficient tape tension sensing and braking mechanisms to avoid tensions that would break the tape or stop the tape while splicing the new roll to the expired supply roll.

The use of splices to join ends of rolls of web material is disclosed in a number of patents. One such patent is the U.S. Pat. No. 4,917,327, (Asbury, et al.), which discloses a splicing system for splicing the tail of one tape to the leading portion of another. The first tape 12 is provided at its trailing end with a pin element 16. A second tape 18 is provided at its leading end with a loop element 22. When the pin engages the loop, the tapes become linked, causing the trailing end of the first tape to pull the leading end of the second tape into the machine. The patent family includes U.S. Pat. No. 5,029,768 and Canadian Patent No. 1,280,097.

A splicing tape is known from U.S. Pat. No. 5,692,699, (Weirauch, et al.), disclosing a tape with a splicing portion (1,2) and an attachment portion (10", 41). The tape disclosed has an attachment portion (10", 41) for attaching the splicing portion (1,2) and separating the splicing portion from the surface of the underlying layer. This patent is directed to a specific splicing tape for use with a roll of paper to attach the end of the roll to the outer wrap on the roll.

A splicing method is disclosed in U.S. Pat. No. 5,913,991, (Kubota, et al.), for attaching a length of magnetic tape to a leader. The apparatus provides for aligning ends of the tapes with the ends of the leaders extending from a cassette and for splicing the ends using vacuum holders for the ends. There is no disclosure of splicing "on the fly".

Another patent, U.S. Pat. No. 5,573,626, (Rossini et al.), discloses a tape splicing machine which can splice adhesive tapes in the supply roll to the lead end of the subsequent roll. The tapes 24 and 26 are guided to the splicing station and between the splicing rollers 212 and 252. When the supply tape nears the end and results in the triggering of the microswitch to actuate the solenoid 230, such that roller 212 is carried toward the roller 252 having the lead end of tape 44 positioned to contact the supply tape 42. When the splice is made, the tape 42 makes contact with the tape 44 and the splice is made and the tape 42 is cut. See columns 23 through 26. In column 24, beginning in line 56, the patent describes the manual set up necessary to make the next splice.

U.S. Pat. No. 5,624,526, (Perecman, et al.) is also directed to a tape splicing apparatus to splice a second tape to a supply tape in an apparatus to make the splice "on the fly." The supply tape is directed through a guide in the splicing apparatus, where an applicator element is moved from a staging position toward the tape guide path to a splice position and then back to its staging position. The supply tape is then cut and the machine readied for the subsequent splice.

SUMMARY

A splicing system affording the splicing of successive web materials from supply rolls to afford a continuous web of material to an applicator, includes first and second guide rollers defining a web path for a web material from the supply rolls. Supports for the placement of a first supply roll and for a second supply roll of web material and the rollers define the path of the supply of web material. The present invention uses a length of pressure sensitive tape. The pressure sensitive tape is placed in overlapping fashion on the end of the second web and extends therepast for engaging the present supply of web material near the end thereof. The splicing tape is supported on a tape placement arm having support means to receive and hold the splicing tape and the leading end of the web from the second supply roll. The placement arm is supported on a pivot for movement from the standby position toward one of the first and second rollers. A knife, triggered by the splice and movement of the second web cuts the supply web that is expiring upon the placement of the splicing tape in contact with the supply web.

A knife holder is movable in a transverse direction in relationship to the web path from a standby position to a position in alignment with the supply web and for cutting the supply web upon the splicing tape making connection to the supply web. When the splice is made by the splicing tape, actuation of the cutting knife moves the cutting knife into the supply web cutting the same and placing the second web in the web path.

The actuation of the knife holder moves the knife from a standby position, transverse to the path of supply web. From this position for the knife holder, the knife moves from a rest or normal position to a position to separate the supply web from the supply roll. The actuation of the knife results from actuation of the placement means from a standby position to a splicing position.

The method of the present invention affords the continuous delivery of web material to an applicator, for applying the adhesive coated web material. For example, to apply reinforced fiber tape strips, like Sesame® tape, (available from H. B. Fuller Company of St. Paul, Minn.), cutting edge tape strips, or a transfer tape to a carton, shipping box, overnight mailer, flexible packaging container; for wrapping a product, such as a bundle of wood products; for sealing boxes; or for winding web material.

An example of cutting edge tape is a film tape coated with adhesive for application to the carton board of a carton for a convolutely wound roll of sheet material in which the tape serves as the cutting edge on the carton for the material. The tape is formed of a polymeric film material in a continuous strip, which is stiff enough, when applied to the free edge of a carton to provide the cutting function. The tape is used in the carton manufacturing process to be applied to the carton material as the same moves through the carton forming machine in the machine direction. The tape is applied at one station in the process to laminate the adhesive coated surface against the carton board and is then cut to form a cutting edge along the edge of the front panel or the closing flap on the lid. The tape may be cut to form a straight edge or a serrated edge. Alternatively, the tape is cut to form serrations along one edge during the manufacture of the rolls of tape. The application of the cutting edge tape takes place at one station and after a registered amount of tape is dispensed, registered and laminated to the carton board adjacent to the edge of the carton board forming the free upper edge of the front panel, it is cut from the roll. In either process, a continuous supply of tape is desired. This is described in more detail in co-pending application Ser. No. 09/154,005 incorporated herein by reference.

Examples of some applicators can be found in U.S. Pat. No. 5,759,339, (Hartman), which describes an apparatus for dispensing a ribbon into a web laminating machine including movable guide arms; U.S. Pat. No. 4,925,521, (Asbury, et al.), which describes an apparatus for intermittently applying lengths of thermoplastic tape; U.S. Pat. Nos. 4,503,108, 4,481,065, 4,481,055, 4,481,054 and 4,451,515, (Clausen, et al.), which describe methods and devices for use in the method for forming a reinforcing filament network; U.S. Pat. No. 4,452,837, (Clausen, et al.), which describes a web reinforced with string-type adhesive and its method of manufacture; U.S. Pat. No. 4,394,206, (Clausen, et al.), which describes an apparatus and method for applying an elongated tab to a moving substrate; U.S. Pat. No. 4,285,758, (Clausen, et al.), which describes a bonding apparatus for applying a thermoplastic adhesive coated core material to a moving substrate; U.S. Pat. No. 4,150,800, (Clausen, et al.), which describes an apparatus for dispensing a plurality of string members, in particular thread or filaments coated with hot melt adhesives, to a machine wherein the string members are applied to a moving web, all incorporated herein by reference.

BRIEF DESCRIPTION OF THE DRAWINGS

The present invention will be described with reference to the accompanying drawing wherein.

DETAILED DESCRIPTION

The present invention provides an improved apparatus and method for providing continuous web material to an applicator machine, which may be a machine for applying the adhesive coated web to a carton for reinforcing, for forming a cutting edge, for a wrapping machine for wrapping a product, a box sealing machine for applying a "c-clip" of tape for closing boxes, or a web winding machine. The present apparatus, as illustrated, may be used on a box sealer wherein the web is a backing that includes a coating of hot melt adhesive on at least one side of the backing.

The splicing system of the present invention affords the splicing of successive web materials from supply rolls to afford a continuous web and, with reference to the accompanying drawing, a first web is drawn through an apparatus on guide rolls. When the supply of a first web nears the end, a splice is made to a second roll of web material to avoid interruption of the supply of web material. Positioned at a standby position is a length of splicing tape secured to the free end of the second roll of web material. As the supply roll nears the end, the splicing tape, held in the standby position by a placement arm, is moved into contact with the web path. Making engagement between the splicing tape and the supply web connects the two webs. After making connection the webs move together along the path. Advancing the supply web and the second web along the path increases the tension in the second web. Tensioning of the web material triggers a knife to move from the standby position into the path of the supply web material. The second web is initially threaded up to the placement arm, and when the knife holder moves transversely to the splicing position, the second web is moved to a position about a roller positioned on the knife holder, and upon the attachment of the second web to the supply web, the second web increases in tension as the unwind from the new roll is commenced. This increase in tension actuates the knife, which is pivoted from a biased normal position to a position through the supply web, piercing the web. The placement arm is returned by the actuator and movement of the knife holder laterally of the web path to its standby position disengages the roller positioned on the knife holder from the second web and the knife is returned to the normal position by a spring. The supply roll is removed and a new (third) roll is placed upon the roll spindle.

Figure 1:
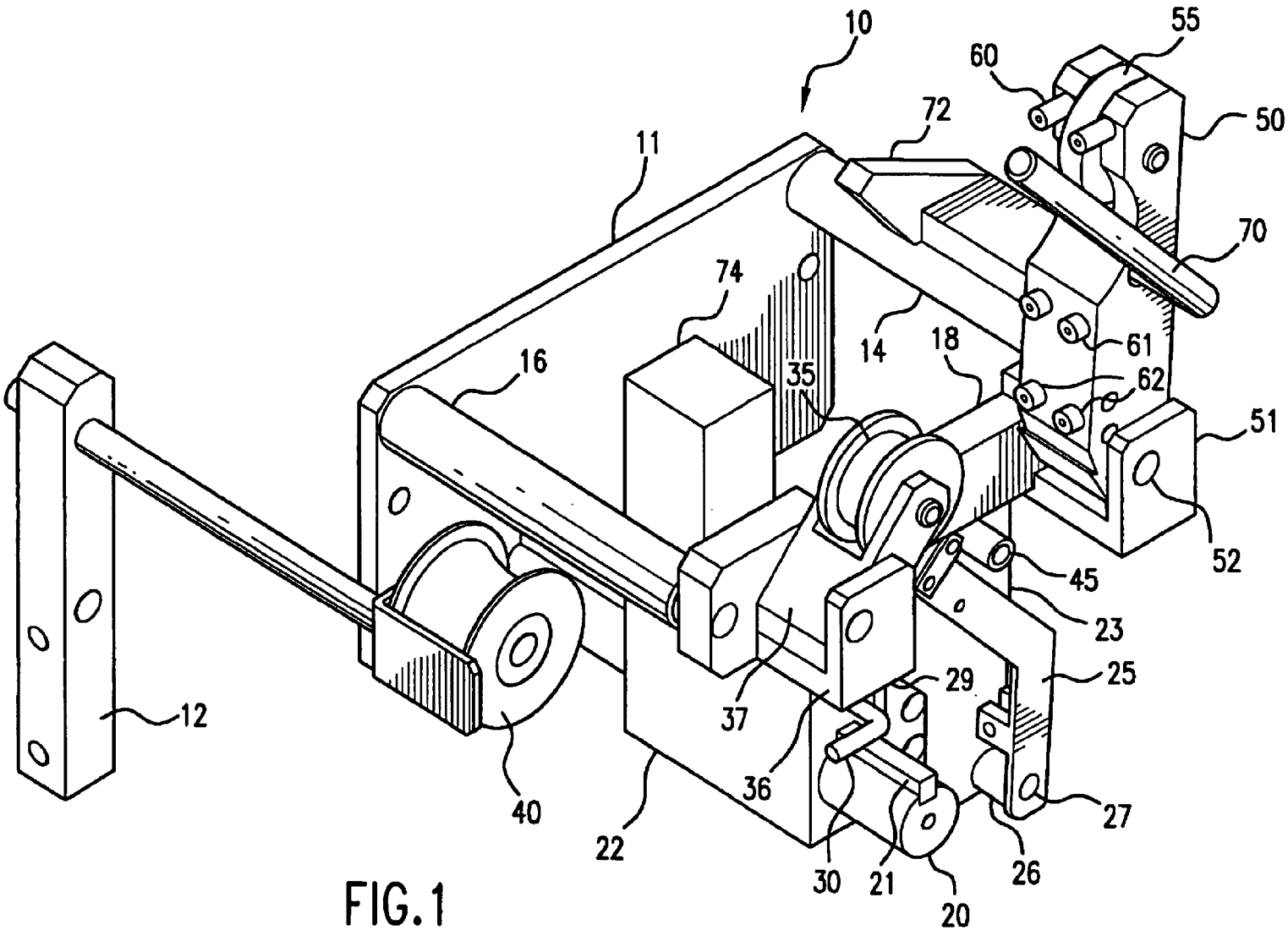
FIG. 1 is a perspective view of the splicing apparatus of the present invention, the view showing the upper left, top and front view.
Figure 2:
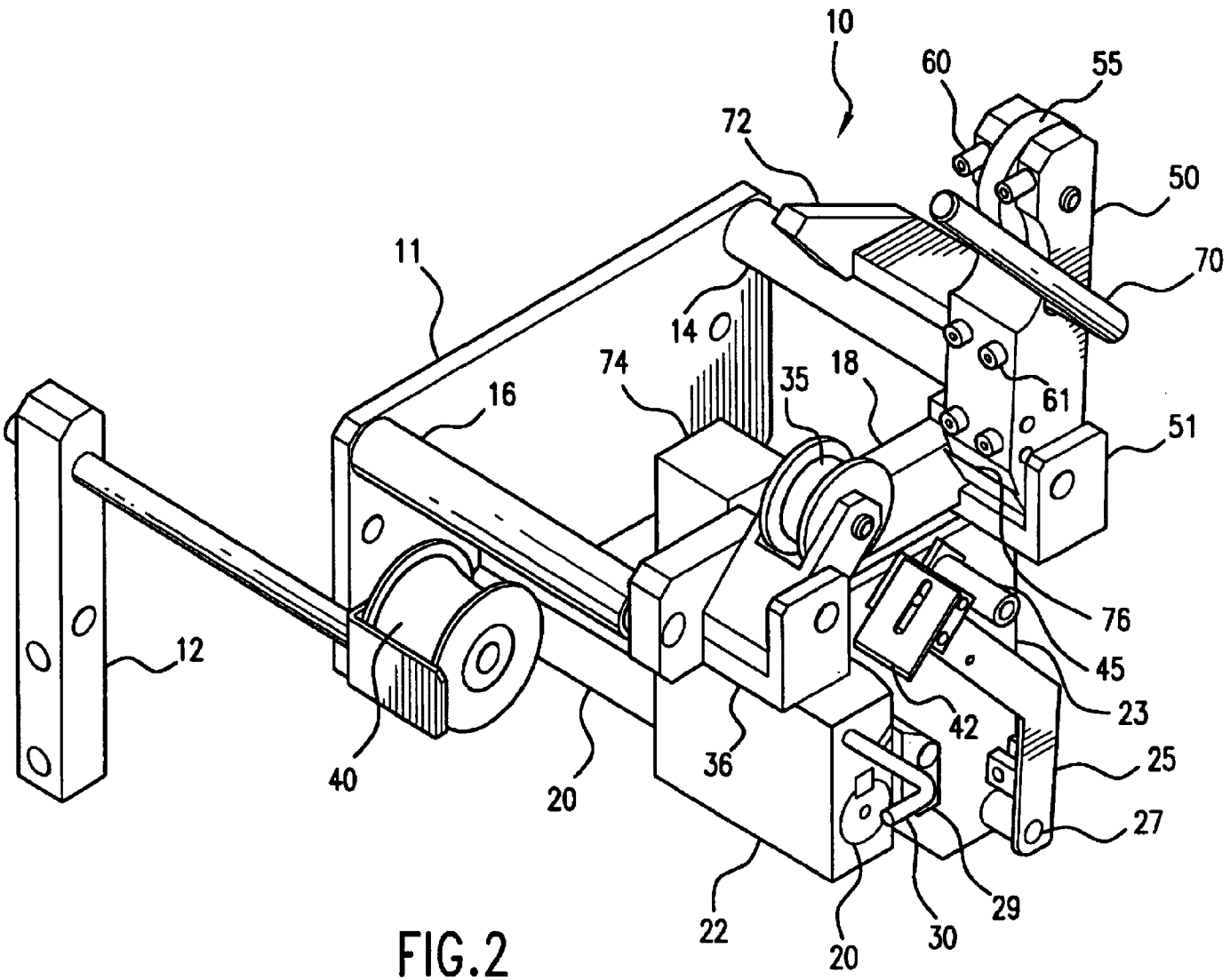
FIG. 2 is a perspective view of the splicing apparatus corresponding to FIG. 1 with the knife holder moved from the standby position to the splicing position.

As shown in FIG. 1, the splicing apparatus 10 comprises a support member having a support plate 11 and a support bracket 12. Extending from the support plate 11 are two spacer rods 14 and 16 which support at their ends a bar 18. A keyed shaft 20 extends from the support plate 11 parallel to the rods 14 and 16. The shaft 20 has a key 21 thereon, positioned on the top of the shaft, to slidably support a knife holder assembly including an "L-shaped" block 22. The block 22 supports a plate 23 upon which a knife arm 25 is supported for pivotal movement by a stub shaft 26 and a pin 27. The block 22 is keyed to restrict rotation of the block 22 and plate 23 about the shaft 20. The plate 23 supports a stop 29, positioned in the path of the knife holder. The plate 23 and block 22 also supports a handle 30 used to move the knife holder, including block 22 and plate 23, from a standby position to an operative position, toward the outboard end of the shaft 20 as shown in FIG. 2.

Figure 5:
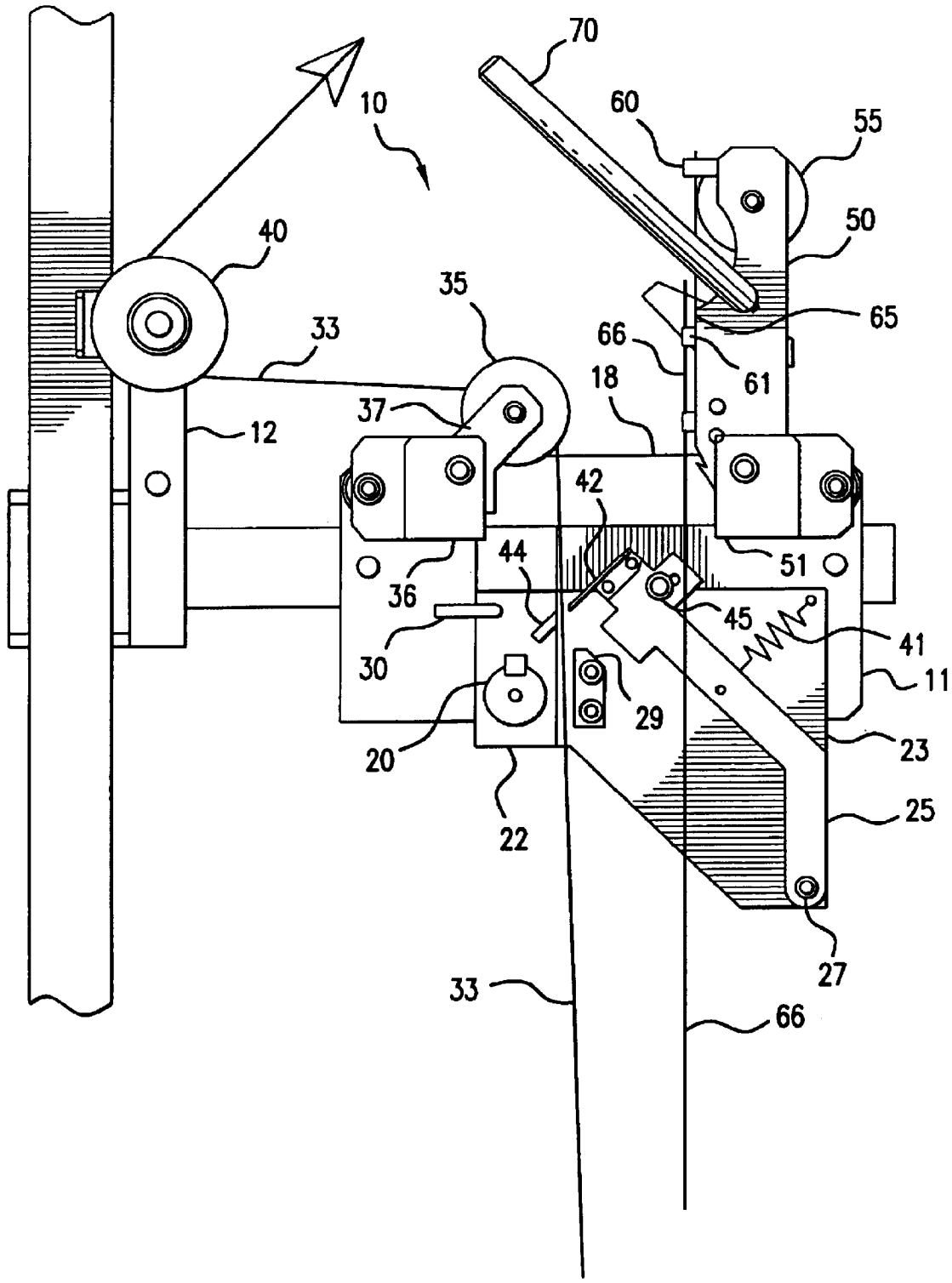
FIG. 5 is a front view showing the web path and the parts in standby position; with the webs disclosed diagrammatically on the placement arm.

FIG. 5 illustrates the tape path of the supply tape or web 33 moving through the splicing apparatus 10 adjacent to the block 22 and over a first idler roll 35 supported on the bar 18 by a bracket 36 and a yoke 37, the yoke having spaced arms between which the shaft supporting the roll 35 is mounted. The roll 35 is freely rotatable. From the idler roll 35 the tape or web 33 passes around a second idler roll 40 and toward the applicator.

Figure 3:
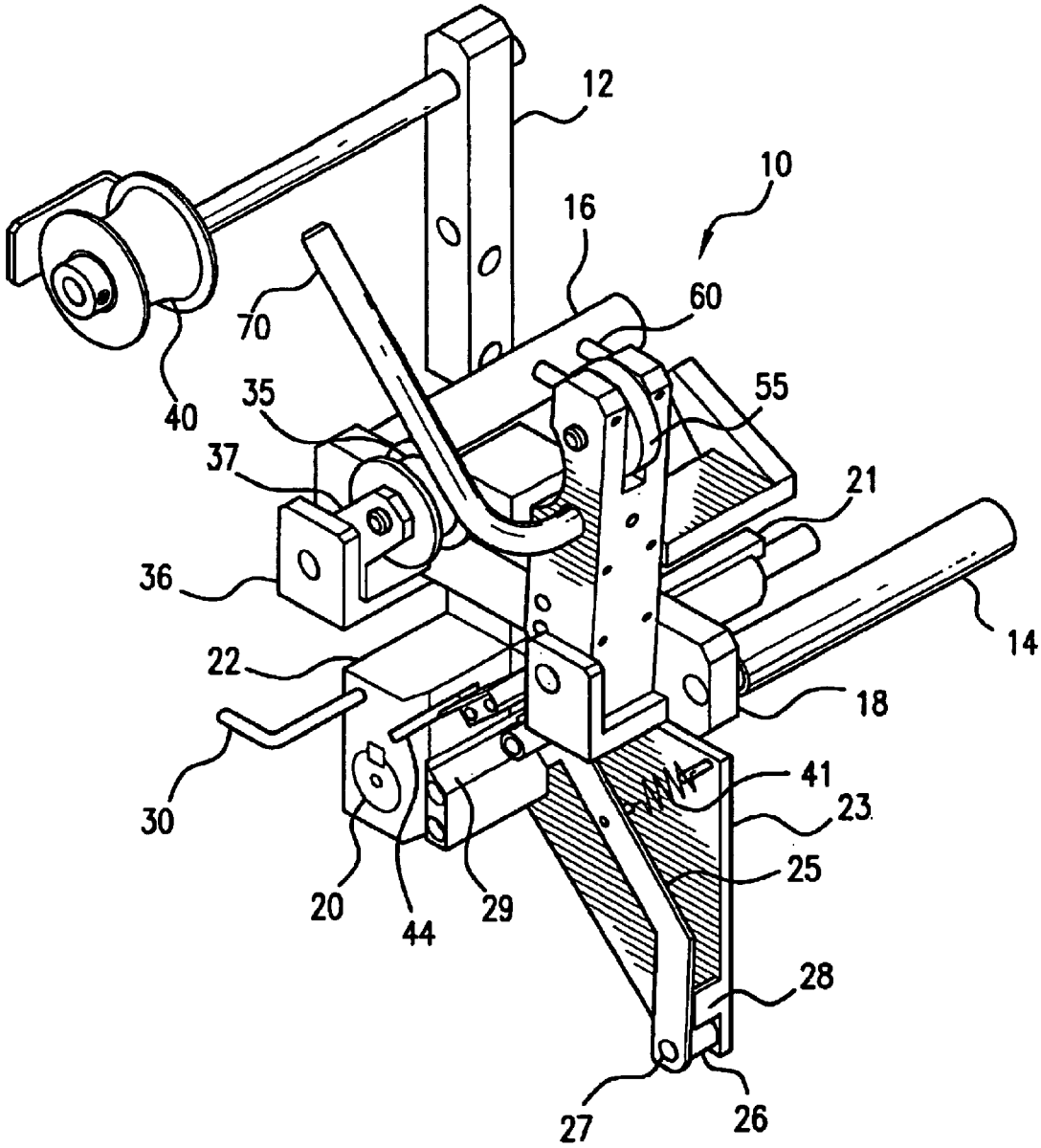
FIG. 3 is a perspective view of the splicing apparatus showing the right, top and front of the apparatus.
Figure 4:
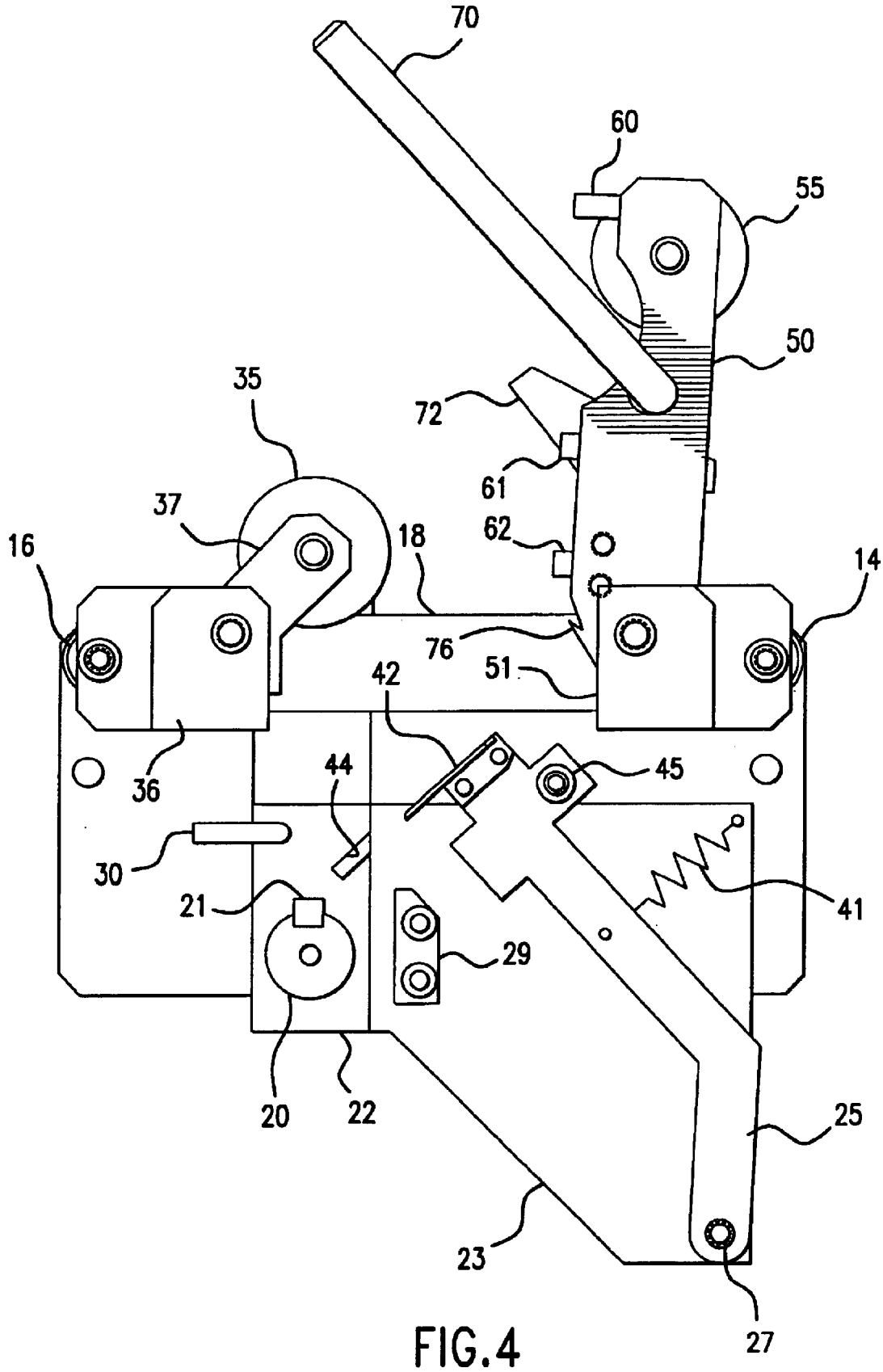
FIG. 4 is a front view of the splicing apparatus.

The knife holder also includes the arm 25 pivoted by a pin 27 to move from a standby position, afforded by a stop 28 behind the arm, see FIGS. 1 and 3, and a biasing means illustrated as a spring 41, to a position against the stop 29, where a knife blade 42 is driven across the path of the tape or web 33 and into a groove 44 in the side of the block 22. The knife holder also supports a roller 45 on the arm 25. The roller 45 is positioned on the arm toward the end supporting the blade 42 and on the side opposite the cutting edge.

Figure 6:
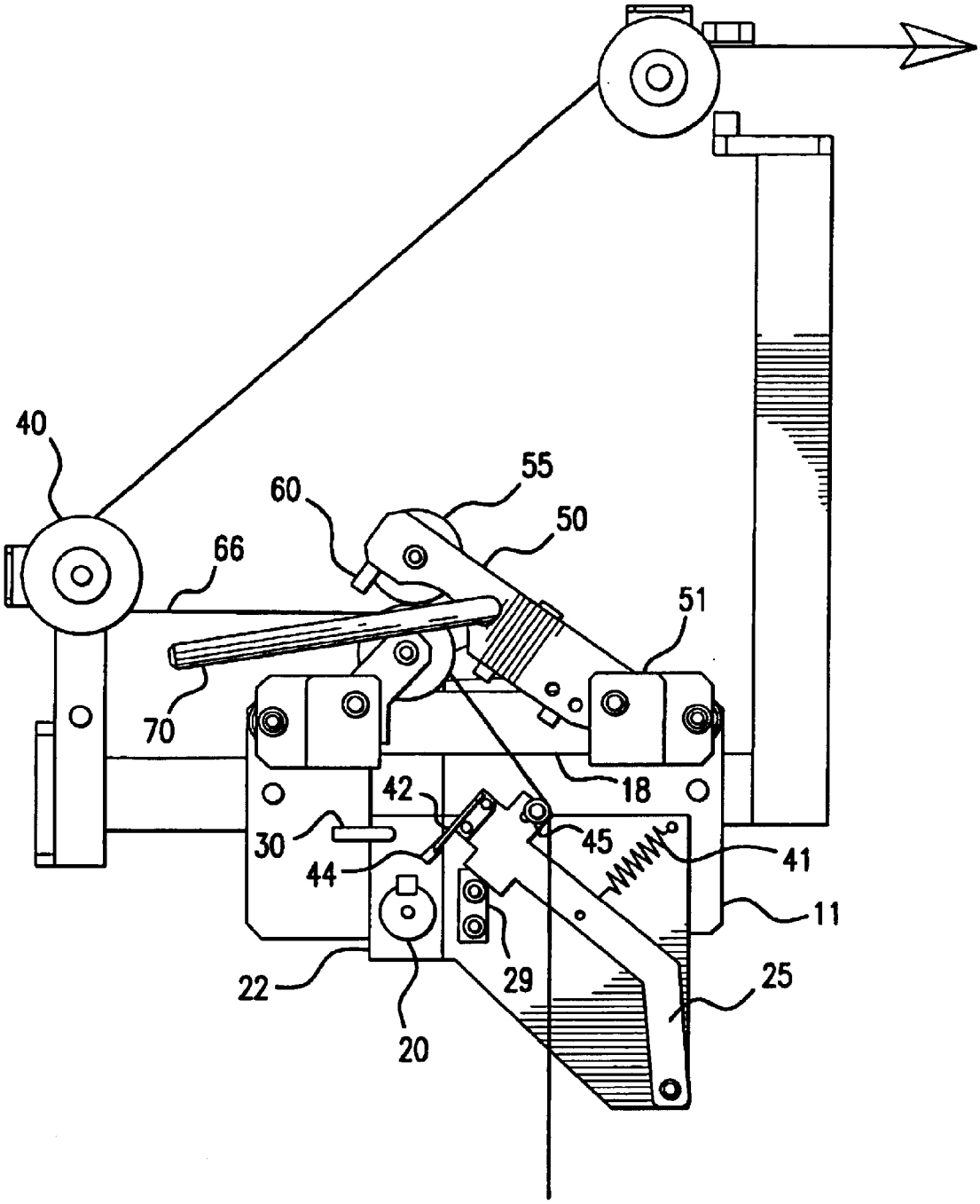
FIG. 6 is a front view showing the parts and web path following the splicing of the second web to the exhausted supply web.
Figure 8:
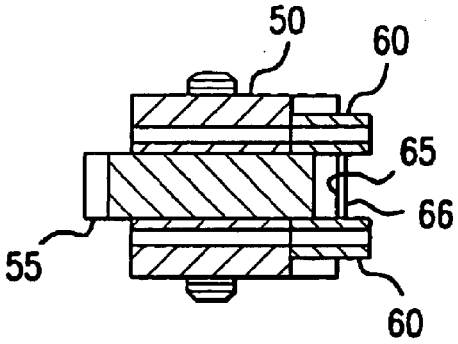
FIG. 8 is a sectional view of the placement arm taken along the line A—A of FIG. 7.
Figure 10:
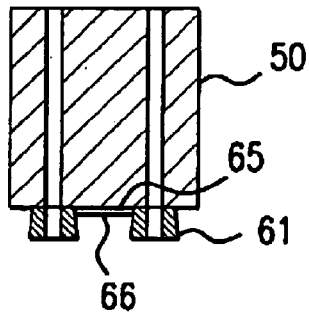
FIG. 10 is a sectional view of FIG. 9 taken along the line B—B.
Figure 7:
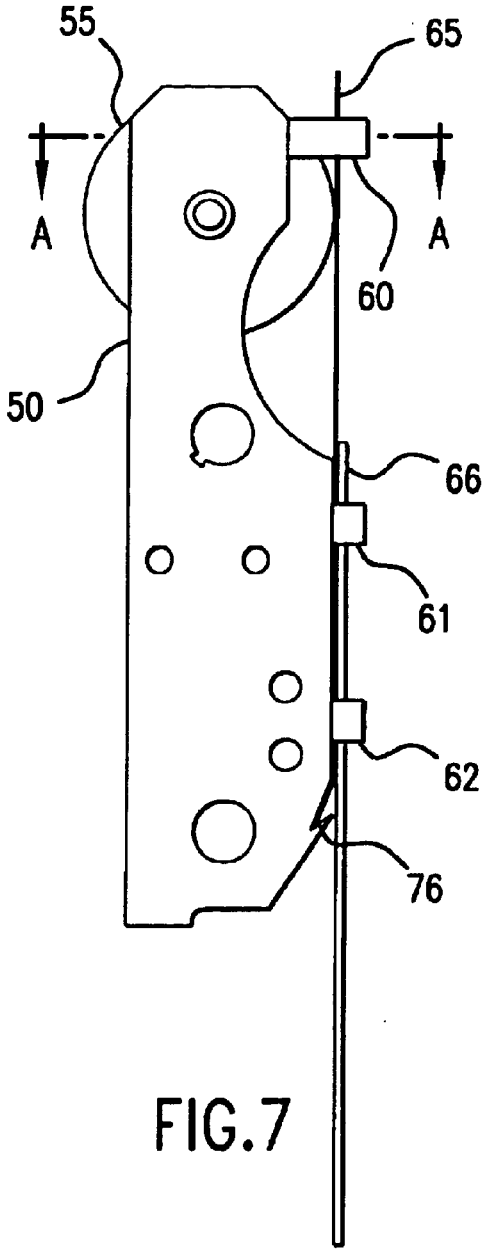
FIG. 7 is a detail view of the rear side of the placement arm.
Figure 9:
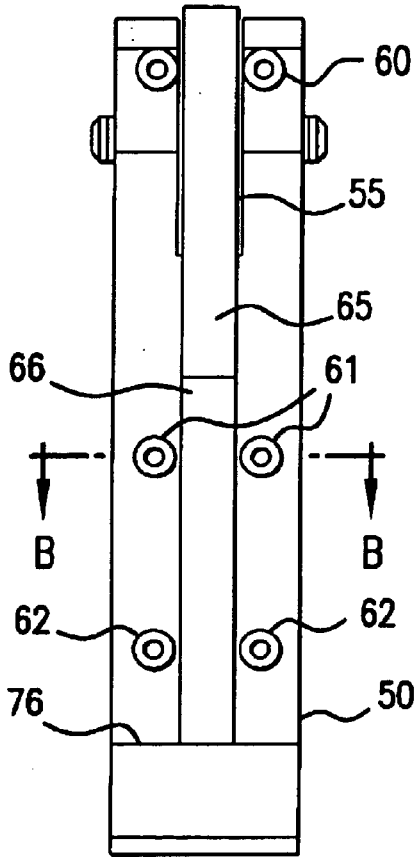
FIG. 9 is a detail view of the left side of the placement arm.

Supported on the bar 18 near the end supported by the rod 14 is a web placement arm 50. The web placement arm 50 is supported from the bar 18 by a bracket 51 and is pivoted on a pin 52. The placement arm 50 comprises a block with a first generally flat side and a second support surface or side having a recessed end portion spaced from the pivot pin 52. The block is forked near the end of reduced thickness near the recessed area, defining a slot between the sides. Supported in the slot between the arms at the forked end, is a wheel 55 which has a diameter sufficient to extend beyond either side of the arms. The second support side is formed with pins, see FIGS. 7–10, to retain a length of splicing tape 65 and the end 66 of the second roll of web material. As shown in FIG. 8 there are spaced pins 60 of uniform diameter to receive one end of a splicing tape 65 therebetween. Two other sets of pins 61 and 62 are formed with cone shaped pins, see FIGS. 9 and 10, which are tapered or cone shaped, with the end of smaller diameter next to the second surface of the placement arm 50, to retain an end of the splicing tape 65 and the end 66 of the second roll of web material upon the placement arm 50. The placement arm 50 also has an actuator handle 70 attached thereto affording the movement of the placement arm 50 from a standby position as shown in FIGS. 1 and 3 to a splicing position, as shown in FIG. 6, wherein the placement arm 50 is moved counter clockwise to the extent necessary to place the splicing tape 65 into engagement with the supply tape or web 33 on or at the roller 35, placing the adhesive coated side of the length of pressure sensitive tape forming the splicing tape 65 firmly into engagement with the supply tape or web 33. The placement arm 50 also has a limit bar 72, which limits the pivotal movement of the placement arm 50. This limit bar 72 engages a stop 74, see FIG. 2, on the top of the block 22. The stop 74 is moved to a position to engage the limit bar 72 when the block 22 is moved to the splice position on the free outboard end of the shaft 20. A detent on the bracket 51 retains the placement arm 50 in the normal standby position readied for a splicing operation. Movement of the block 22 is limited by the side thereof forming the stop 74. The raised portion of block 22 forming the stop engages the bar 18.

The placement arm 50 is also formed with a transverse groove 76 in the second side of the placement arm near the pivot. This groove 76 receives and supports one end of the splicing tape 65 when it is initially placed on the placement arm 50 with an adhesive coated surface exposed. When the free end of the second roll of web material is placed on the placement arm 50, between the sets of pins 61 and 62, it is placed in adhesive contact with the end of the splicing tape 65 below the recessed area of the block forming the placement arm 50.

In operation, the supply tape or web 33 is threaded through the splicing apparatus over the rollers 35 and 40. During the time the supply web 33 is moving through the splicing apparatus, a length of the pressure sensitive splicing tape 65 is placed on the placement arm 50 between the pins 60, with the other end resting in the groove 76. The free end 66 of the second roll of web is drawn from the roll and a side opposite an adhesive coated side is placed against the adhesive coated side of the splicing tape 65 and between the sets of pins 61 and 62 which hold the end of the web material on the placement arm 50. As the web material 33 on the supply roll nears the end, the knife holder is moved from the standby position transversely of the web path to the inline position by the actuator handle 30. As the knife holder is moved along the shaft 20, the web 66 of the second roll is placed between the roller 45 and the bracket 51 placing the roller 45 on the side of the second web near the knife blade 42. The actuator handle 70 is then moved to rapidly place the splicing tape 65 in contact with the supply web 33 on the roller 35 so the extended end of the splicing tape makes firm contact with the supply tape or web 33. The end of the second web 66 is then following the supply web path toward the applicator, and tension is built up in the second web and forms an actuator together with the roller 45 to trigger the cutting of the supply web 33. The actuator means quickly draws the roller 45 toward the roller 35 to drive the knife and arm 25 toward the supply web 33 with the knife blade 42 cutting through the supply web 33 to separate it from the second web, and the knife blade 42 is driven into the slot 44 and the knife arm 25 against the stop 29. The splicing tape 65 and the leading end of the second web 66, positioned on the supply web 33, is drawn around the roller 40 with the hot melt adhesive coated side of both tapes positioned away from the roller 40. The handle 30 is then moved inward to move the knife holder, including plate 23, knife arm 25, roller 45, and the block 22 inward on the shaft 20 out of the plane of movement of the web. The placement arm 50 is moved back to the standby position and another length of splicing tape 65 is placed on the second side or face thereof and the supply roll is removed from the spindle and a new (third) roll of web material put in its place.

The splicing tape 65 has a pressure sensitive adhesive coated on two surfaces. The pressure sensitive adhesive can be a water based pressure sensitive adhesive, solvent based pressure sensitive adhesive, or a hot melt pressure sensitive adhesive. An example of a useful adhesive is HM-1902, (available from H. B. Fuller Company of St. Paul, Minn.). An example of pressure sensitive coated tape is Tape 444, (available from 3M Company of St. Paul, Minn.). The tape is applied to the side of the second roll of the supply web opposite a coated surface thereof.

The adhesive tapes to be spliced can be made with a hot melt adhesive, a hot melt remoistenable adhesive, a water dispersible hot melt adhesive, a biodegradable hot melt adhesive or a repulpable hot melt adhesive. Examples of these adhesives are hot melt adhesives such as an ethylene-vinyl acetate copolymer-based hot melt adhesive, ethylene methylacrylate-based hot melt adhesive, ethylene n-butyl acrylate-based hot melt adhesive, hot melt adhesives based on polyethylene and polypropylene homopolymers, copolymers and interpolymers, and rubbery block copolymer hot melt adhesives. Examples of adhesives for splicing tape 65 include hot melt pressure sensitive adhesives including, e.g., metallocene-based hot melt pressure sensitive adhesive such as those that include at least one homogeneous linear or substantially linear interpolymer of ethylene and at least one $C_3$ to $C_{20}$ alpha-olefin and ethylene methylacrylate-based hot melt pressure sensitive adhesives. Water-based pressure sensitive adhesives such as acrylic and styrene-acrylic type adhesives and water-based adhesives made from polyvinyl acetate, vinyl acetate-ethylene copolymers or starch and combinations thereof are also available.

Having described the invention with reference to accompanying illustrations of the apparatus of the present invention, it is contemplated that engineering changes can be made without departing from the spirit or scope of the invention as set forth in the appended claims. Other embodiments are within the claims.

What is claimed:

1. A method of splicing web material to afford a continuous feed of web material to an applicator, comprising the steps of:

advancing a first web material along a path and around a roller;

placing a length of splicing tape on an end portion of a second web material with a free end portion of the length of splicing tape extending beyond the end portion of the second web material;

moving the free end portion of the length of splicing tape into engagement with the first web material as the first web material is moving about the roller to attach the length of splicing tape to the first web material;

moving a cutting knife assembly comprising a cutting knife along an engagement direction from a standby position to a cutting position; and actuating the cutting knife to cut the first web material by moving the cutting knife in a cutting direction that is different from the engagement direction, wherein the first web material and the end portion of the second web material are connected by the splicing tape.

2. The method according to claim 1, wherein the first web material has two major sides, the cutting knife assembly surrounds the first web material on at least the two major sides when the cutting knife assembly is in the cutting position, and the cutting knife assembly does not surround the first web material on either of the two major sides when the cutting knife assembly in the standby position.

3. The method according to claim 1, including the step of placing the length of splicing tape and the end portion of the second web material onto a pivoted placement arm for movement into engagement with the roller.

4. The method according to claim 1, wherein moving the cutting knife assembly comprising the cutting knife along the engagement direction from the standby position to the cutting position comprises manually moving a handle to place the cutting knife in the cutting position, the cutting position is adjacent to the path as an end of the first web material approaches, and the first web material is cut after the first web material and the second web material are connected by the splicing tape.

5. The method according to claim 1, wherein moving the cutting knife assembly from the standby position to the cutting position comprises manually moving a knife holder transversely of the web path to place the cutting knife in the cutting position, the cutting position is adjacent to the path as an end of the first web material approaches, and the first web material is cut after the first web material and the second web material are connected by the splicing tape.

6. The method according to claim 1, wherein the applicator is a tape applicator for applying an adhesive coated web to a carton and the method further comprises applying the adhesive coated web to a carton.

7. The method according to claim 6, wherein the adhesive coated web is cutting edge tape.

8. The method according to claim 1, wherein the web material is reinforcing tape.

9. The method according to claim 1, wherein the applicator is a machine for wrapping a product.

10. The method according to claim 1, wherein the applicator is a box sealing machine for applying a "c-clip" of web material to boxes.

11. The method according to claim 1, wherein the applicator is a web winding machine.

12. A method of splicing web material to provide a continuous feed of web material to an applicator, the method comprising:

advancing a first web material along a first path and around a roller;

placing a length of pressure sensitive adhesive tape on an end portion of a second web material, a free end portion of the pressure sensitive adhesive tape extending beyond the end portion of the second web material;

moving the free end portion of the pressure sensitive adhesive tape and the end portion of the second web material against the first web material about the roller such that the pressure sensitive adhesive tape attaches to the first web material;

advancing the first web material along the first path after the pressure sensitive adhesive tape attaches to the first web material; and actuating a cutting knife to cut the first web material such that the first web material and the end portion of the second web material are connected and a portion of the first web material overlaps the second web material, wherein the cutting knife is positioned on a movable cutting arm and the cutting knife is moved toward the first web material by pressure exerted on the cutting arm by the second web material.

13. A method of splicing web material to afford a continuous feed of web material to an applicator, comprising the steps of:

advancing a first web material along a path and around a roller;

placing a length of pressure sensitive adhesive tape on an end portion of a second web material with a free end portion of the length of pressure sensitive adhesive tape extending beyond the end portion of the second web material;

moving the free end portion of the length of pressure sensitive adhesive tape into engagement with the first web material as the first web material is moving about the roller to attach the length of pressure sensitive adhesive tape to the first web material; and actuating a cutting knife to cut the first web material, wherein the first web material and the end portion of the second web material are connected by the length of pressure sensitive adhesive tape, actuating the cutting knife comprises moving a cutting knife assembly into alignment with the first web material, and the cutting knife assembly comprises the cutting knife, a plate, a block supporting the plate, an arm supporting the cutting knife, and a roller on the arm that can be engaged by the second web material to drive the cutting knife through the first web material after the first web material and the second web material are attached by the length of pressure sensitive adhesive tape.

14. A method for connecting a first length of tape to a second length of tape, comprising:

attaching a third length of tape to an end of the second length of tape such that the third length of tape has an unattached portion that extends beyond the end of the second length of tape;

moving a cutting knife assembly from a disengaged position into alignment with the first length of tape, wherein the cutting knife assembly comprises a cutting arm comprising a cutting knife, and the cutting arm is movable along a cutting direction that is traverse to the first length of tape when the cutting knife assembly is in alignment with the first length of tape;

moving the unattached portion of the third length of tape into engagement with the first length of tape at an engagement point after attaching the third length of tape to the end of the second length of tape and while the first length of tape is in motion;

moving the cutting arm in the cutting direction to cut the first length of tape at a cutting point that is downstream of the engagement point; and moving the cutting knife assembly back into the disengaged position.

15. A method for connecting a first length of tape to a second length of tape, comprising:

attaching a third length of tape to an end of the second length of tape such that the third length of tape has an unattached portion that extends beyond the end of the second length of tape;

connecting the first length of tape to the second length of tape by moving the unattached portion of the third length of tape into engagement with the first length of tape at an engagement portion after attaching the third length of tape to the end of the second length of tape and while the first length of tape is moving in a tape flow direction such that the first length of tape pulls the second length of tape in the tape flow direction; and cutting the first length of tape at a cutting point that is downstream of the engagement point by moving a cutting arm along a cutting path that is traverse to the first length of tape, wherein the cutting arm comprises a cutting knife and a roller, the second length of tape engages the roller as the unattached portion of the third length of tape is moved into engagement with the first length of tape or immediately thereafter, and the cutting arm is moved along the cutting path by pressure exerted by the second length of tape on the roller as the first length of tape pulls the second length of tape in the tape flow direction.

16. The method according to claim 15, further comprising moving a cutting knife assembly from a disengaged position into alignment with the first length of tape before cutting the first length of tape, wherein the cutting arm is positioned on the cutting knife assembly, the cutting path is traverse to the first length of tape when the cutting knife assembly is in alignment with the first length of tape, and the cutting path is not traverse to the first length of tape when the cutting knife assembly is in the disengaged position.

17. The method according to claim 16, further comprising moving the cutting knife assembly back into the disengaged position after cutting the first length of tape.

18. The method according to claim 17, wherein the second length of tape falls out of engagement with the roller when the cutting knife assembly is moved back into the disengaged position.

19. The method according to claim 15, wherein the cutting arm moves along the cutting path by pivoting at a pivot point on the cutting knife assembly.

20. The method according to claim 15, wherein the cutting arm is positioned on a cutting knife assembly comprising a slot and the cutting knife cuts the first length of tape by extending through the first length of tape and into the slot.

21. The method according to claim 15, wherein the cutting arm is positioned on a cutting knife assembly comprising a biasing member and the biasing member resists movement of the cutting arm along the cutting path.

* * * * *